US009681746B1

(12) United States Patent
Chen

(10) Patent No.: US 9,681,746 B1
(45) Date of Patent: Jun. 20, 2017

(54) PLATFORM ON DESKTOP WITH ELEVATION FUNCTION

(71) Applicant: Su-Ming Chen, Kaohsiung (TW)

(72) Inventor: Su-Ming Chen, Kaohsiung (TW)

( * ) Notice: Subject to any disclaimer, the term of this patent is extended or adjusted under 35 U.S.C. 154(b) by 0 days.

(21) Appl. No.: 15/299,488

(22) Filed: Oct. 21, 2016

(30) Foreign Application Priority Data

Sep. 26, 2016 (TW) ..... 105214727 U

(51) Int. Cl.

| | |
|---|---|
| ***A47B 9/00*** | (2006.01) |
| ***A47B 21/02*** | (2006.01) |
| ***A47B 9/16*** | (2006.01) |
| ***A47B 9/02*** | (2006.01) |

(52) U.S. Cl.
CPC ..... *A47B 21/02* (2013.01); *A47B 9/02* (2013.01); *A47B 9/16* (2013.01)

(58) Field of Classification Search
CPC .. A47B 21/02; A47B 9/02; A47B 9/16; A47B 9/14
See application file for complete search history.

(56) References Cited

U.S. PATENT DOCUMENTS 2,156,148 A * 4/1939 Di Giacomo ..... A47D 1/02 248/421
3,245,366 A * 4/1966 Fox ..... A47B 9/18 108/145
4,691,888 A * 9/1987 Cotterill ..... A47B 21/02 108/1
5,588,377 A * 12/1996 Fahmian ..... A47B 9/00 108/145
8,544,391 B2 * 10/2013 Knox ..... B60N 3/063 108/12
9,326,598 B1 * 5/2016 West ..... A47B 3/02
9,480,332 B2 * 11/2016 Han ..... B60P 3/34
9,504,316 B1 * 11/2016 Maxwell ..... A47B 21/02
2004/0040480 A1 * 3/2004 Hwang ..... A47B 3/02 108/145
2008/0203865 A1 * 8/2008 Chouinard ..... A47B 21/02 312/223.3
2013/0139736 A1 * 6/2013 Flaherty ..... A47B 9/18 108/106
2014/0041554 A1 * 2/2014 Huang ..... A47B 9/16 108/50.11
2015/0216296 A1 * 8/2015 Mitchell ..... B62B 3/02 108/21
2015/0289641 A1 * 10/2015 Ergun ..... A47B 9/16 108/42
2016/0286951 A1 * 10/2016 Chung ..... A47B 9/16
2016/0338486 A1 * 11/2016 Martin ..... A47B 9/16

* cited by examiner

*Primary Examiner* — Hanh V Tran
(74) *Attorney, Agent, or Firm* — Leong C. Lei

(57) ABSTRACT

Disclosed is a platform on desktop with elevation function, including a primary desktop, a primary desktop, an elevation assembly securely mounted to the primary desktop, and a secondary desktop securely mounted to the elevation assembly. The elevation assembly includes opposite arranged first and elevation frames. A positioning assembly includes a positioning member having spaced positioning holes to selectively receive an end of an upper guide pin mounted to a bar of the elevation assembly. A pull handle assembly is rotatably coupled to the positioning member for selectively disengaging the upper guide pin from the positioning member so as to allow the elevation frame to raise or lower down.

7 Claims, 10 Drawing Sheets

PLATFORM ON DESKTOP WITH ELEVATION FUNCTION

(a) TECHNICAL FIELD OF THE INVENTION

The present invention relates generally to a platform on desktop with elevation function, and more particularly to a desktop platform that is disposed on a top of a regular office desk and is movable for changing elevation in order to improve utilization performance of the office desk.

(b) DESCRIPTION OF THE PRIOR ART

Office desks are commonly provided in an office for office staffs to improve working performance.

As shown in FIG. 1, a fixed office desk 1 is commonly used due to being inexpensive. However, the fixed office desk 1 has a fixed height and an office staff, when feeling tired, must stand up for stretching, perhaps still handling office job at the same time, in order to maintain or improve working performance. Since the height of the desk 1 is fixed, it does not allow for change of the height to suit the need for a user to handle his or her jobs.

Thus, it is a challenge of the office furniture manufacturers to provide a height-adjustable platform that allows for change of elevation or height and can be placed on the conventional fixed office desk 1 to allow a user to change the height of the desk according to physical needs or requirement of work.

SUMMARY OF THE INVENTION

The primary objective of the present invention is to provide a platform on desktop with elevation function for the purposes of improving utilization of an office desk and preventing a significant increase of cost for upgrading an office desk with an elevation function.

In this regard, the technical solution of the present invention according to claim 1 provides a platform on desktop with elevation function, which comprises a primary desktop, an elevation assembly securely mounted to the primary desktop, and a secondary desktop securely mounted to the elevation assembly, wherein the elevation assembly comprises at least a first elevation frame and a second elevation frame that are arranged opposite to each other in a left-right direction, a cross bar connected between the first elevation frame and the second elevation frame; the first and second elevation frames each comprise an upper connection plate, a positioning assembly mounted on the upper connection plate, an elevation bar assembly having an upper end connected to the upper connection plate, a lower connection plate to which a lower end of the elevation bar assembly is connected; the upper connection plate comprises an upper slide guiding opening formed therein and the lower connection plate comprises a lower slide guiding opening formed therein; the positioning assembly is arranged at one side of the upper slide guiding opening of the upper connection plate and the positioning assembly comprises a positioning member, a pull handle assembly coupled to the positioning member, and two pusher assemblies respectively received and extending through two end portions of the positioning member; the positioning member comprises a plurality of spaced positioning holes formed in one side thereof that faces toward the upper slide guiding opening and the positioning member is provided with mounting sections on a side thereof that is opposite to the side forming the positioning holes such that the mounting sections are arranged for coupling with the pull handle assembly, the positioning member being provided with through barrel sections respectively provided on opposite sides of the mounting sections, the through barrel sections respectively receiving the pusher assemblies to extend therethrough; the elevation bar assembly is arranged such that the upper end thereof connected to the upper connection plate and the lower end connected to the lower connection plate; the elevation bar assembly comprises a first bar, a second bar intersecting and pivotally connected to the first bar to show a cross form, and a return spring connected between the first bar and the second bar; the first bar has an upper end to which an upper guide pin is mounted and the first bar has a lower end to which a lower guide pin is mounted and the upper guide pin is put through and received in the upper slide guiding opening of the upper connection plate and the lower guide pin of the first bar is put through and received in a lower slide guiding opening formed in the lower connection plate; and an end of the upper guide pin is selectively receivable into the positioning holes of the positioning member for positioning so that a stable positioning of the elevation bar assembly is achievable for a raised or lower height thereof.

The efficacy that the technical solution of the present invention according to claim 1 may achieve is that the elevation bar assembly is structured through connection of the first bar and the second bar that are arranged to intersect each other to show a cross form and are pivotally coupled to each other and two ends of the first bar are allowed to slide with respect to and between the upper slide guiding opening of the upper connection plate and the lower slide guiding opening of the lower connection plate so that in an elevation or lowering operation of the elevation bar assembly, an end of the upper guide pin is receivable in to one of the positioning holes of the positioning member to be positioned thereby so as to provide an effect of stable positioning for the raised or lowered height of the elevation bar assembly.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
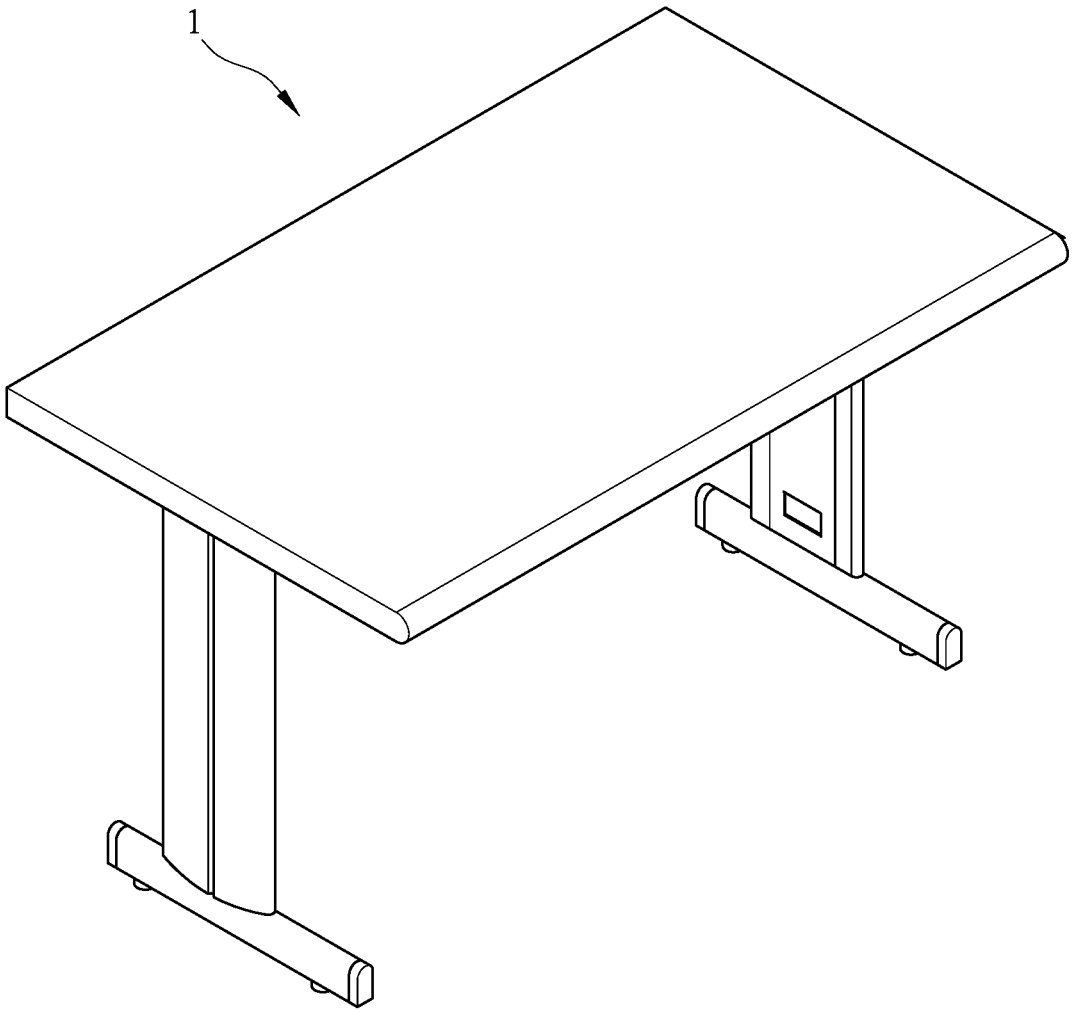
PRIOR ART FIG.1
FIG. 1 is a schematic view showing a prior art office desk.
Figure 2:
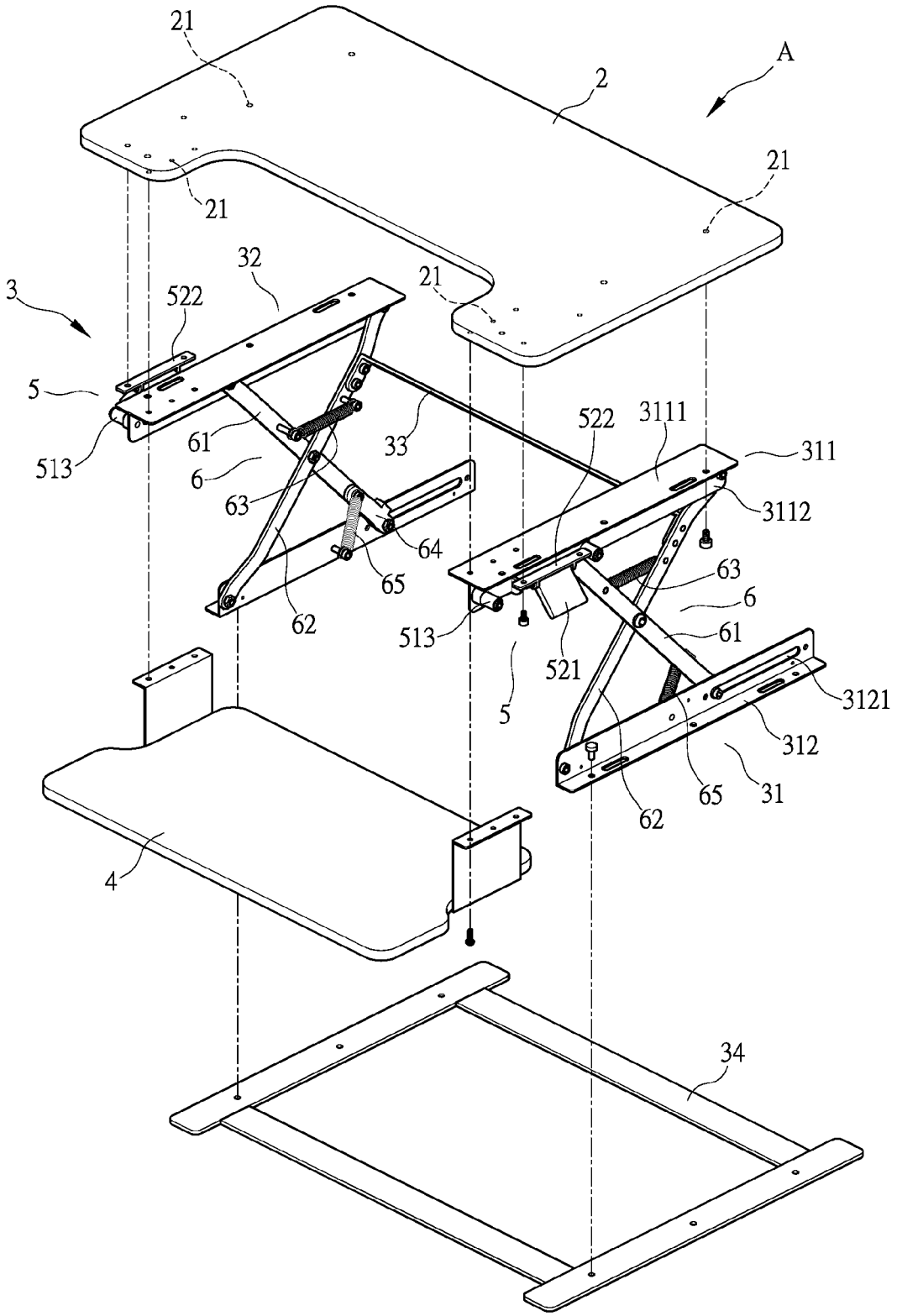
FIG. 2 is an exploded view showing a desk with elevating or height-adjustable platform according to the present invention.
Figure 3:
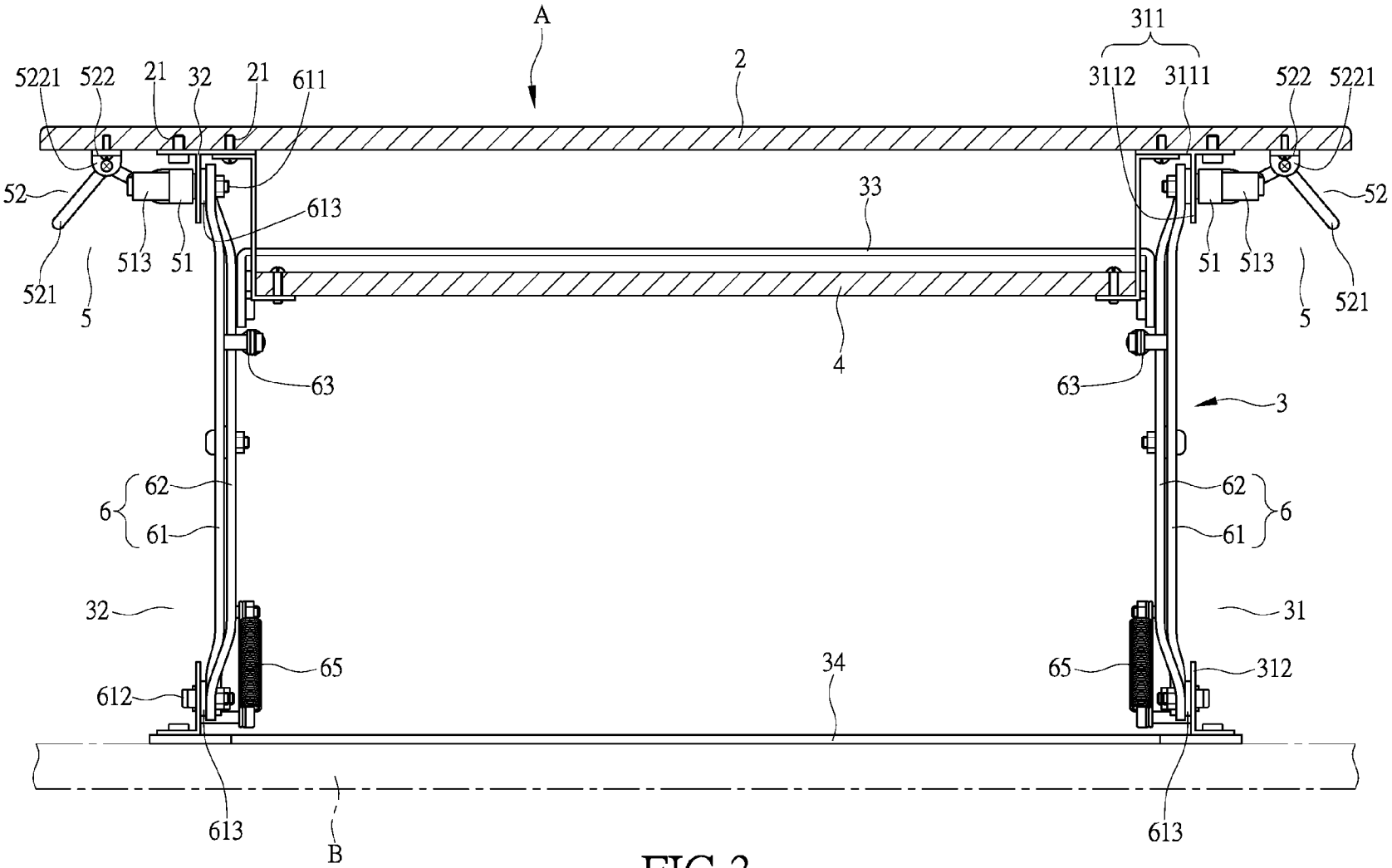
FIG. 3 is a front view illustrating the desk with height-adjustable platform according to the present invention in an assembled and elevated condition.

Referring firstly to FIGS. 2 and 3, the present invention provides a platform on desktop with elevation function, which is designated at A and will also be referred to as a height-adjustable platform, comprises a primary desktop 2, an elevation assembly 3 securely mounted to the primary desktop 2, and a secondary desktop 4 securely mounted to the elevation assembly 3.

As shown in FIGS. 2 and 3, the primary desktop 2 comprises a plurality of mounting holes 21 formed therein. The primary desktop 2 is mounted, via the plurality of mounting holes 21, to the elevation assembly 3.

Figure 4:
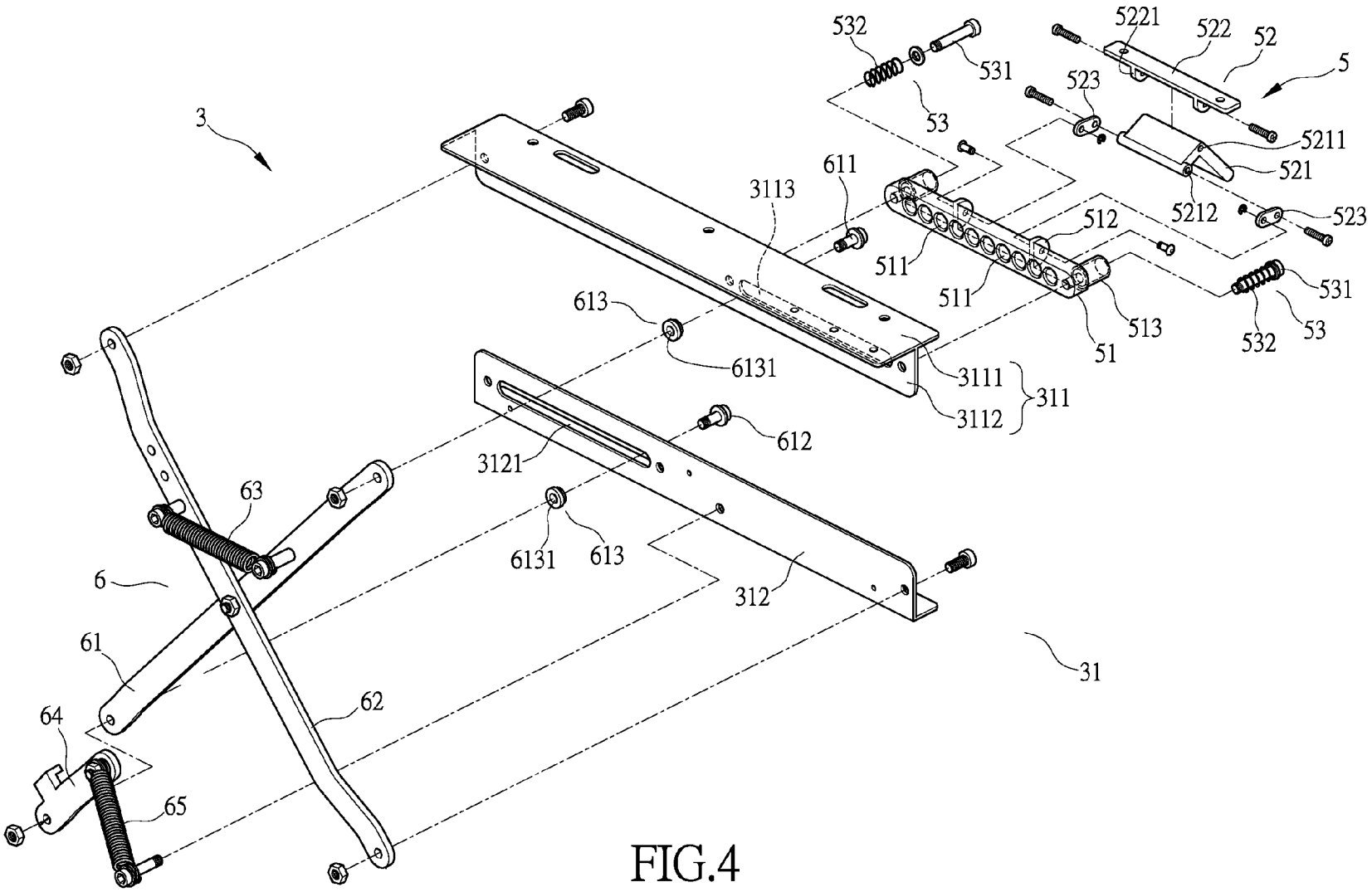
FIG. 4 is a perspective view illustrating a first elevation frame of an elevation assembly according to the present invention.
Figure 5:
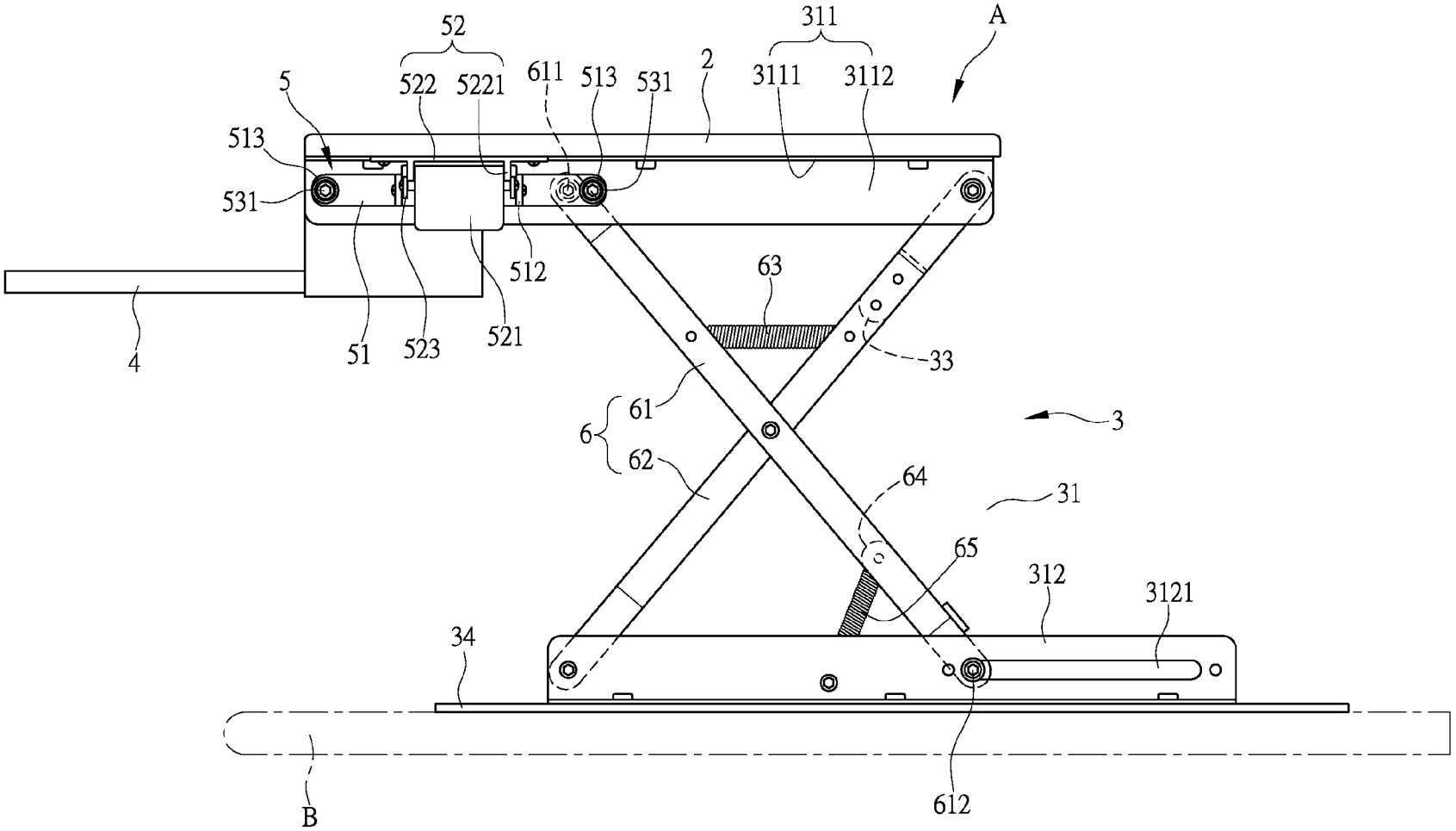
FIG. 5 is a side elevational view illustrating the desk with height-adjustable platform according to the present invention in an assembled and elevated condition.
Figure 6:
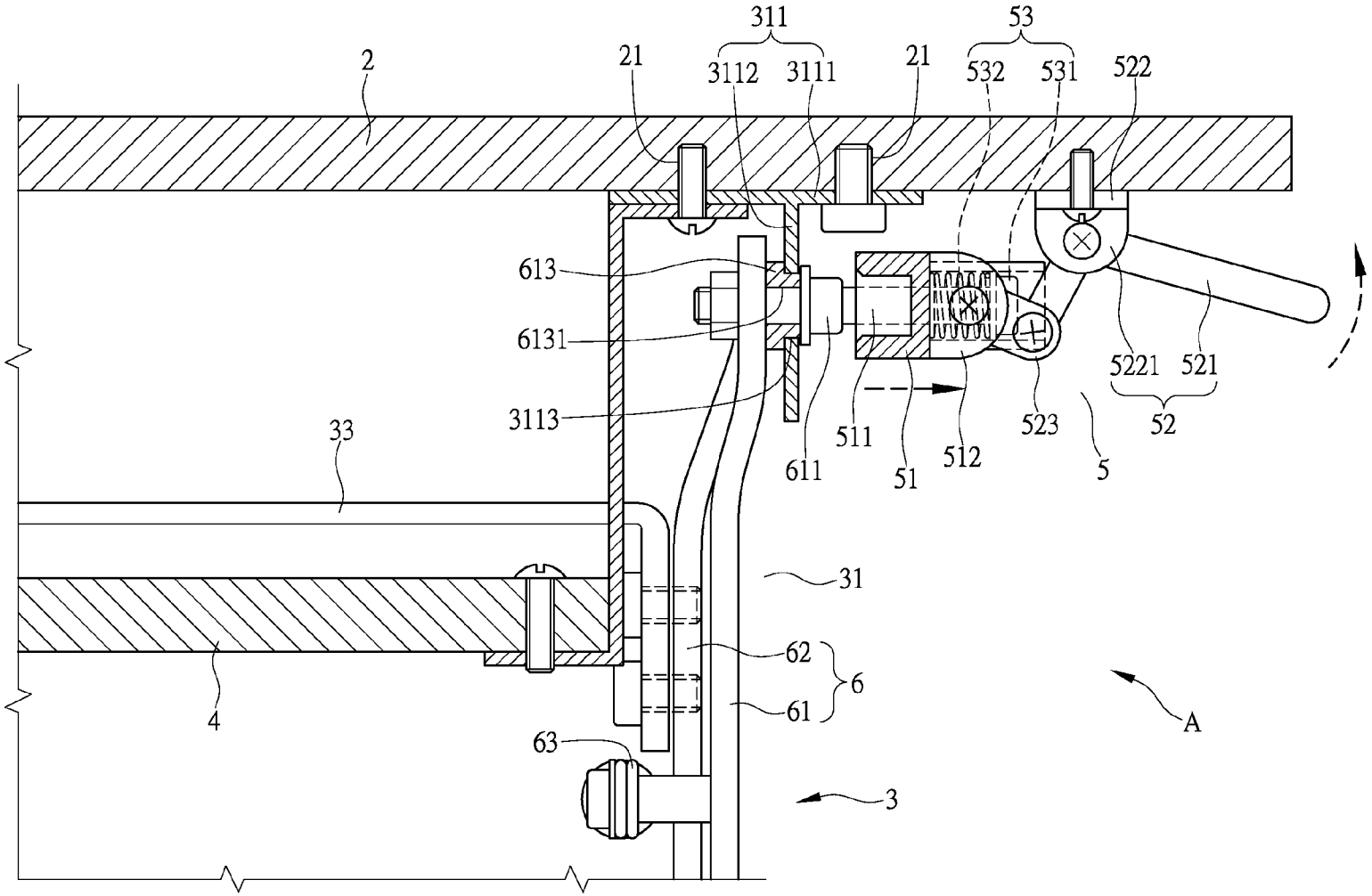
FIGS. 6 and 7 are schematic views illustrating an operation of a positioning member disengaging from an upper guide pin according to the present invention.
Figure 7:
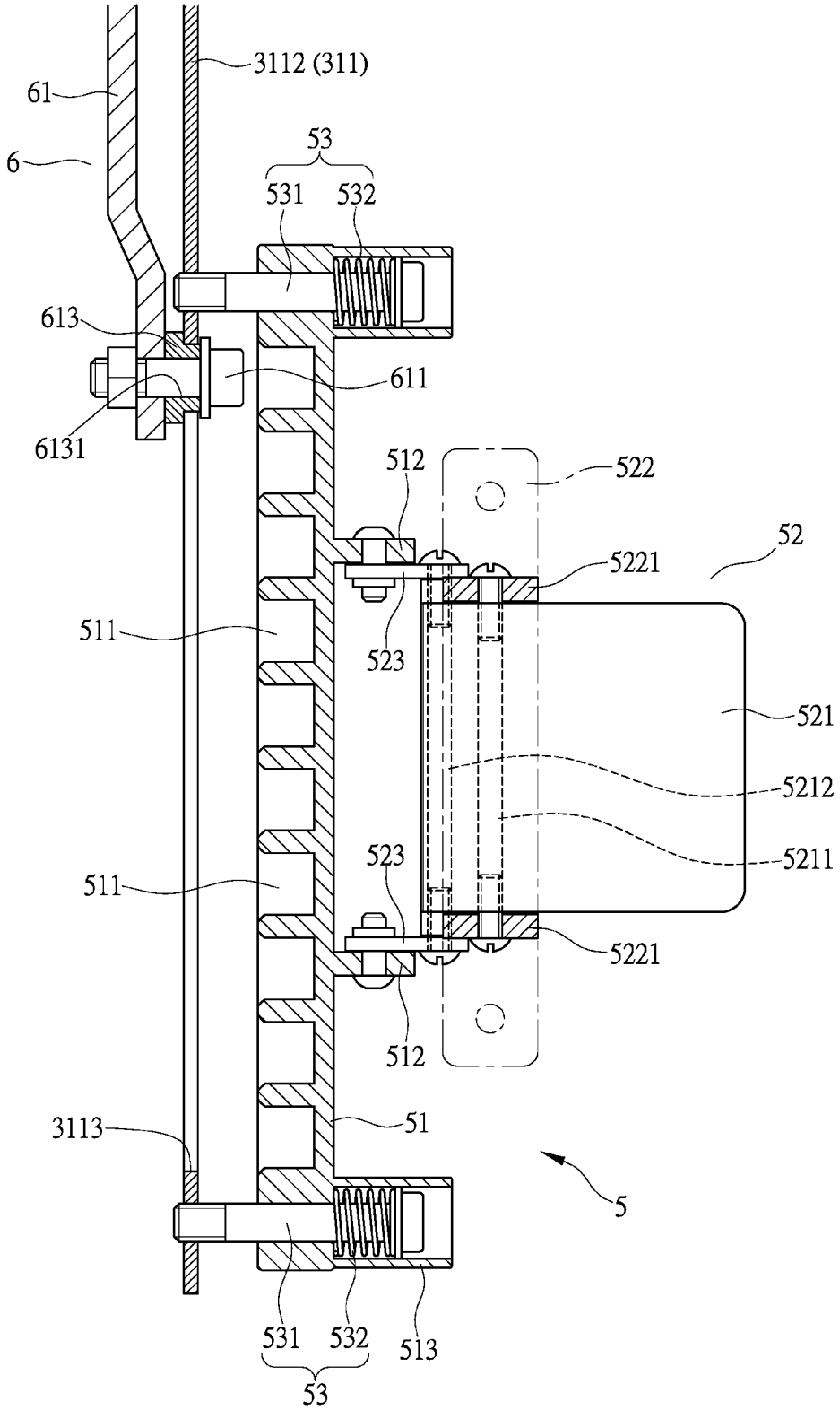
Figure 8:
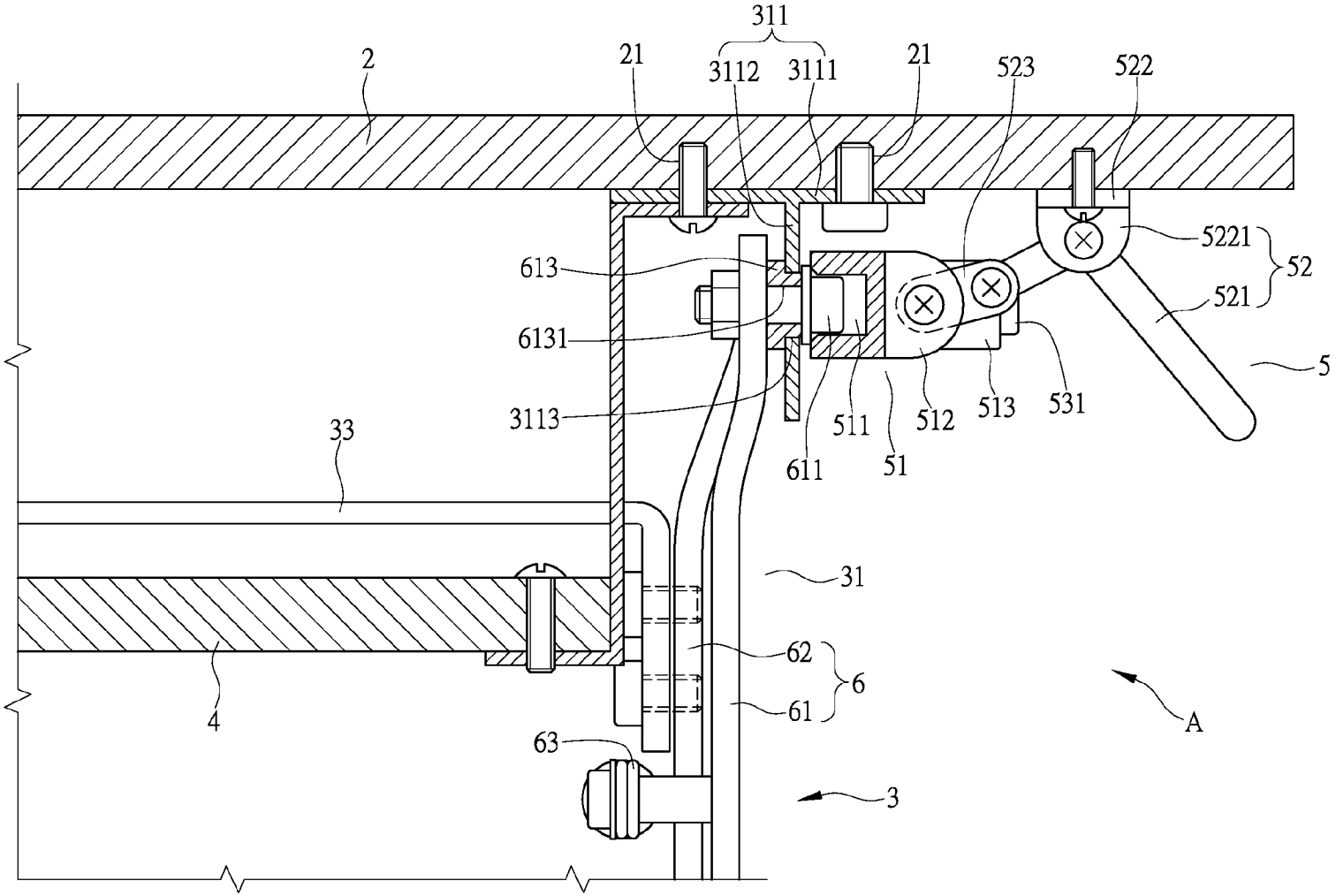
FIGS. 8 and 9 are schematic views illustrating an operation of the positioning member engaging and positioning with respect to the upper guide pin according to the present invention.
Figure 9:
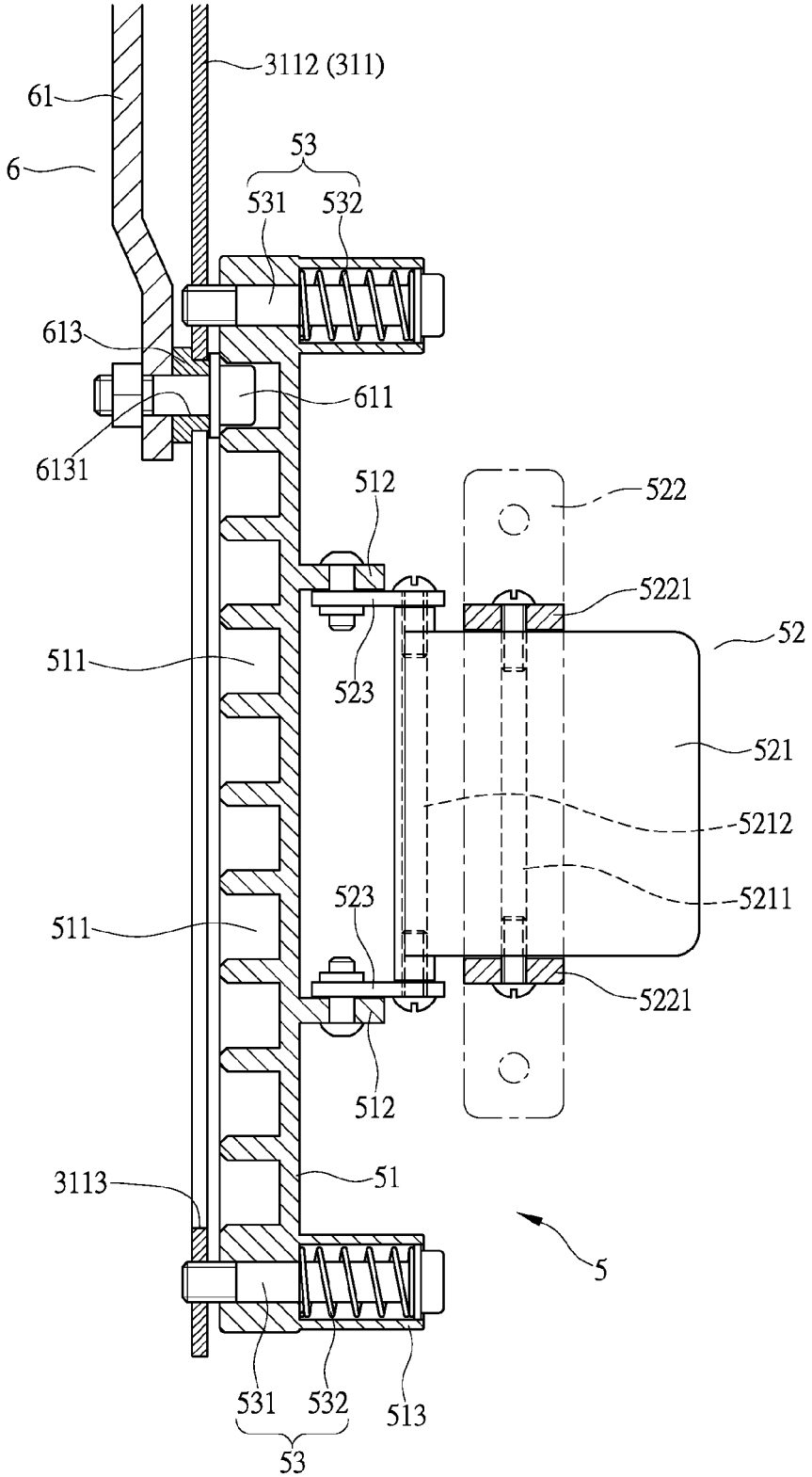
Figure 10:
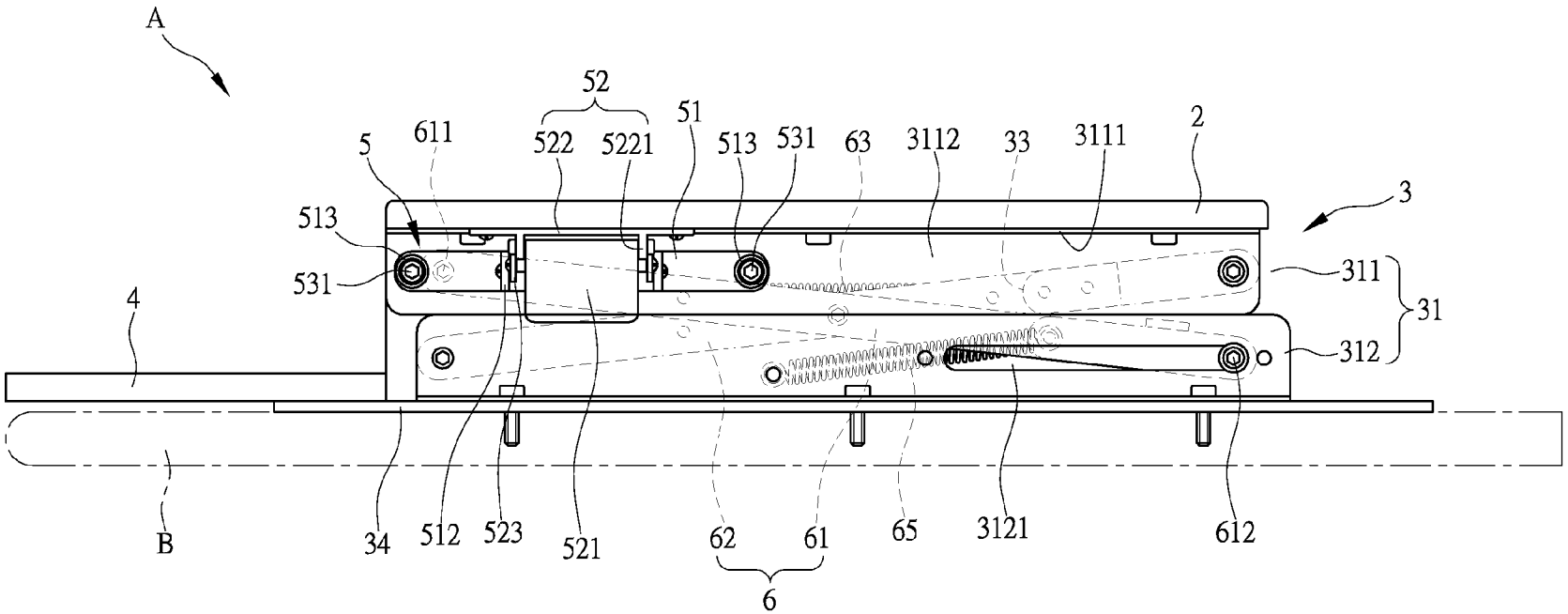
FIG. 10 is a side elevational view illustrating the desk with height-adjustable platform according to the present invention in an assembled and lowered condition.

As shown in FIGS. 2, 3, and 4, the elevation assembly 3 comprises a first elevation frame 31 and a second elevation frame 32 that are arranged opposite to each other in a left-right direction, a cross bar 33 connected between the first elevation frame 31 and the second elevation frame 32, and a bottom frame 34 to which bottoms of the first elevation frame 31 and the second elevation frame 32 are mounted.

As shown in FIGS. 2, 3, and 4, the first elevation frame 31 and the second elevation frame 32 have identical structures and the first elevation frame 31 will be taken as an example for description and illustration of details thereof in the following, while details of the second elevation frame 32 that are identical to those of first elevation frame will not be repeated herein. The first elevation frame 31 comprises, in sequence from top to bottom, an upper connection plate 311, a positioning assembly 5 mounted on the upper connection plate 311, an elevation bar assembly 6 having an upper end connected to the upper connection plate 311, a lower connection plate 312 to which a lower end of the elevation bar assembly 6 is connected.

As shown in FIGS. 2, 3, and 4, the upper connection plate 311 has a top side that defines a top connection section 3111 in a flat and planar form. The top connection section 3111 is provided to receive the primary desktop 2 mounted thereto. The upper connection plate 311 comprises upper coupling section 3112 that projects downward from the top connection section 3111 such that the top connection section 3111 and the upper coupling section 3112 are arranged to be substantially perpendicular to each other. More precisely speaking, the upper coupling section 3112 is set facing away from the primary desktop 2. The upper coupling section 3112 is provided, with an upper slide guiding opening 3113 formed in one end portion thereof and in the form of an elongate slot.

As shown in FIGS. 2, 3, and 4, the positioning assembly 5 is arranged at one side of the upper slide guiding opening 3113 of the upper coupling section 3112 of the upper connection plate 311. The positioning assembly 5 comprises a positioning member 51, a pull handle assembly 52 coupled to the positioning member 51, and two pusher assemblies 53 respectively received and extending through two end portions of the positioning member 51. The positioning member 51 comprises a plurality of spaced positioning holes 511 formed in one side thereof that faces toward the upper slide guiding opening 3113. The positioning member 51 is provided with mounting sections 512 on a side thereof that is opposite to the side forming the positioning holes 511. The mounting sections 512 are arranged for coupling with the pull handle assembly 52. The positioning member 51 is provided with through barrel sections 513 respectively provided on opposite sides of the mounting sections 512 and the through barrel sections 513 respectively receive the pusher assemblies 53 to extend therethrough.

As shown in FIGS. 2, 3, and 4, the pull handle assembly 52 comprises a handle 521, a joint plate 522 to which the handle 521 is pivotally connected, and linking members 523 for linking the handle 521 and the positioning member 51 to each other. The handle 521 has a cross-section in the form of a V-shaped. The handle 521 comprises pivot holes 5211 and connection hole 5212 formed therein. The joint plate 522 has a top mounted to the primary desktop 2 and the joint plate 522 has a bottom from which two pivot lugs 5221 project outward. The pivot lugs 5221 are provided for pivotal connection with the pivot holes 5211 of the handle 521. The linking members 523 have an end connected to the connection holes 5212 of the handle 521 and the linking members 523 have an opposite end connected to the mounting sections 512 of the positioning member 51.

As shown in FIGS. 2, 3, and 4, the pusher assemblies 53 are respectively received through the through barrel sections 513 of the positioning member 51. The pusher assemblies 53 each comprises a bolt 531 and a push spring 532 fit over and encompassing the bolt 531. The bolt 531 has an end screwed to the upper coupling section 3112 of the upper connection plate 311. More precisely, the bolts 531 are respectively screwed to the upper coupling section 3112 at locations outside two ends of the upper slide guiding opening 3113.

As shown in FIGS. 2, 3, and 4, the elevation bar assembly 6 is arranged such that the upper end thereof connected to the upper connection plate 311 and the lower end connected to the lower connection plate 312. The elevation bar assembly 6 comprises a first bar 61, a second bar 62 intersecting and pivotally connected to the first bar 61 to show a cross form, a return spring 63 connected between the first bar 61 and the second bar 62, an ancillary bar 64 connected to the first bar 61, a tension spring 65 connected between the ancillary bar 64 and the lower connection plate 312. The first bar 61 has an upper end to which an upper guide pin 611 is mounted and the first bar 61 has a lower end to which a lower guide pin 612 is mounted. The upper guide pin 611 is put through and received in the upper slide guiding opening 3113 of the upper connection plate 311 and the lower guide pin 612 of the first bar 61 is put through and received in a lower slide guiding opening 3121 formed in the lower connection plate 312. A filler plate 613 is arranged at each interfacing site of the first bar 61 with the upper slide guiding opening 3113 and the lower slide guiding opening 3121. The filler plate 613 comprises a through hole 6131 formed therein. The arrangement of the filler plate 613 helps reduce the level of noise caused by a sliding movement of the first bar 61 with respect to and between the upper connection plate 311 and the lower connection plate 312. The second bar 62 has an upper end coupled to the upper coupling section 3112 of the upper connection plate 311. The second bar 62 has a lower end coupled to the lower connection plate 312. The elevation bar assembly 6 is structured such that the first bar 61 and the second bar 62 intersect each other in a cross form and pivotally coupled to achieve connection therebetween and two ends of the first bar 61 are respectively slidable with respect to and between the upper slide guiding opening 3113 of the upper connection plate 311 and the lower slide guiding opening 3121 of the lower connection plate 312 in order to achieve an elevating/lowering operation of the elevation bar assembly 6. The ancillary bar 64 is connected to the first bar 61 and the ancillary bar 64 receives the tension spring 65 to connect thereto with an opposite end of the tension spring 65 connected to the lower connection plate 312 so that the tension spring 65 is connected, in an inclined form, between the ancillary bar 64 and the lower connection plate 312 and is located under the return spring 63. The arrangement of the tension spring 65 helps reduce a moving speed of the elevation bar assembly 6 during a lowering operation and also to improve elevation performance of the elevation bar assembly 6.

As shown in FIGS. 2, 3, and 4, the lower connection plate 312 comprises the lower slide guiding opening 3121 formed therein and the lower slide guiding opening 3121 receives the lower guide pin 612 of the first bar 61 therethrough and sliding therein. The lower connection plate 312 receives the lower end of the second bar 62 to couple thereto and a bottom of the lower connection plate 312 is mounted to the bottom frame 34.

As shown in FIGS. 2 and 3, the bottom frame 34 receives the lower connection plate 312 to mount thereto. The bottom frame 34 is a rectangular frame.

As shown in FIGS. 2 and 3, the secondary desktop 4 is mounted to the upper connection plate 311 and, more precisely, the secondary desktop 4 is mounted to the top connection section 3111 of the upper connection plate 311.

In an embodiment of the present invention, the height-adjustable platform A of the present invention is directly installed on a desktop B of an office desk. As shown in FIGS. 3, 5, 8, and 9, the height-adjustable platform A is raised to a highest position thereof, the upper guide pin 611 of the first bar 61 of the elevation bar assembly 6 slides to an end of the upper slide guiding opening 3113 of the upper connection plate 311 (the rightmost location shown in FIG. 5) and the lower guide pin 612 slides, at the same time, to an end of the lower slide guiding opening 3121 of the lower connection plate 312 (the leftmost location shown in FIG. 5) such that one end of the upper guide pin 611 gets into one of the positioning holes 511 of the positioning member 51 to be positioned thereby. In this way, the two ends of the first bar 61 of the elevation bar assembly 6 define a height difference of a maximum available limit so that the primary desktop 2 is raised to a location distant from the desktop B of the office desk, meaning the height-adjustable platform A is in a situation of being raised to a highest position.

As shown in FIGS. 3, 6, 7, 8, 9, and 10, to reduce the height of the height-adjustable platform A, the pull handle assembly 52 is pulled such that the pull handle assembly 52 takes advantage of a leverage effect provided by the linking member 523 to swing the positioning member 51 easily from an initial position, whereby the upper guide pin 611 of which the end is received in the positioning holes 511 of the positioning member 51 is allowed to disengage from the positioning holes 511. Under this condition, the primary desktop 2 can be pressed down to lower the primary desktop and at the same time, the elevation bar assembly 6 is released from constraint to allow ends of the first bar 61 and the second bar 62 to move toward and approach each other. In other words, the elevation bar assembly 6 is in an operation of lowering down until the pull handle assembly 52 is released to allow the pusher assemblies 53 to push the positioning member 51 back to the initial position, where the end of the upper guide pin 611 is received into and kept in position by one of the positioning holes 511 of the positioning member 51. The height of the elevation bar assembly 6 through the elevation or lowering operation thereof is determined or constrained by the one of the positioning holes 511 of the positioning member 51 that receives the end of the upper guide pin 611 to fit therein. In this way, multiple stage positioning of the elevation bar assembly 6 in respect of the height thereof can be achieved for both the elevation operation and lowering operation and this allows a user to select and use a desired height.

The efficacy of the present invention is that the elevation bar assembly 6 comprises a first bar 61, a second bar 62 intersecting and pivotally connected to the first bar 61 to show a cross form, and a return spring 63 connected between the first bar 61 and the second bar 62; the first bar 61 has an upper end to which the upper guide pin 611 is mounted and the first bar 61 has a lower end to which the lower guide pin 612 is mounted, where the upper guide pin 611 is put through and received in the upper slide guiding opening 3113 of the upper connection plate 311 and the lower guide pin 612 of the first bar 61 is put through and received in the lower slide guiding opening 3121 of the lower connection plate 312; the elevation bar assembly 6 is structured such that the first bar 61 and the second bar 62 intersect each other in a cross form and pivotally coupled to achieve connection therebetween and two ends of the first bar 61 are respectively slidable with respect to and between the upper slide guiding opening 3113 of the upper connection plate 311 and the lower slide guiding opening 3121 of the lower connection plate 312; and the positioning assembly 5 comprises a positioning member 51, a pull handle assembly 52 coupled to the positioning member 51, and two pusher assemblies 53 respectively received and extending through two end portions of the positioning member 51; and further that the positioning member 51 comprises the plurality of spaced positioning holes 511 formed in one side thereof that faces toward the upper slide guiding opening 3113 and the positioning member 51 is provided with the mounting sections 512 on a side thereof that is opposite to the side forming the positioning holes 511 such that the mounting sections 512 are arranged for coupling with the pull handle assembly 52 and the positioning member 51 is provided with the through barrel sections 513 respectively provided on opposite sides of the mounting sections 512 and the through barrel sections 513 respectively receive the pusher assemblies 53 to extend therethrough, whereby in an elevation or lowering operation of the elevation bar assembly 6, an end of the upper guide pin 611 is receivable in to one of the positioning holes 511 of the positioning member 51 to be positioned thereby so as to provide an effect of stable positioning for the raised or lowered height of the elevation bar assembly 6.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A platform on desktop with elevation function, comprising a primary desktop, an elevation assembly securely mounted to the primary desktop, and a secondary desktop securely mounted to the elevation assembly, wherein the elevation assembly comprises at least a first elevation frame and a second elevation frame that are arranged opposite to each other in a left-right direction, a cross bar connected between the first elevation frame and the second elevation frame; the first and second elevation frames each comprise an upper connection plate, a positioning assembly mounted on the upper connection plate, an elevation bar assembly having an upper end connected to the upper connection plate, a lower connection plate to which a lower end of the elevation bar assembly is connected; the upper connection plate comprises an upper slide guiding opening formed therein and the lower connection plate comprises a lower slide guiding opening formed therein; the positioning assembly is arranged at one side of the upper slide guiding opening of the upper connection plate and the positioning assembly comprises a positioning member, a pull handle assembly coupled to the positioning member, and two pusher assemblies respectively received and extending through two end portions of the positioning member; the positioning member comprises a plurality of spaced positioning holes formed in one side thereof that faces toward the upper slide guiding opening and the positioning member is provided with mounting sections on a side thereof that is opposite to the side forming the positioning holes such that the mounting sections are arranged for coupling with the pull handle assembly, the positioning member being provided with through barrel sections respectively provided on opposite sides of the mounting sections, the through barrel sections respectively receiving the pusher assemblies to extend therethrough; the elevation bar assembly is arranged such that the upper end thereof connected to the upper connection plate and the lower end connected to the lower connection plate; the elevation bar assembly comprises a first bar, a second bar intersecting and pivotally connected to the first bar to show a cross form, and a return spring connected between the first bar and the second bar; the first bar has an upper end to which an upper guide pin is mounted and the first bar has a lower end to which a lower guide pin is mounted and the upper guide pin is put through and received in the upper slide guiding opening of the upper connection plate and the lower guide pin of the first bar is put through and received in a lower slide guiding opening formed in the lower connection plate; and an end of the upper guide pin is selectively receivable into the positioning holes of the positioning member for positioning so that a stable positioning of the elevation bar assembly is achievable for a raised or lower height thereof.

2. The platform on desktop with elevation function according to claim 1, wherein the elevation assembly further comprises a bottom frame that receives bottoms of the first elevation frame and the second elevation frame to be mounted thereto.

3. The platform on desktop with elevation function according to claim 1, wherein a filler plate is arranged at each of interfacing sites of the first bar with the upper slide guiding opening and the lower slide guiding opening and the filler plate comprises a through hole formed therein.

4. The platform on desktop with elevation function according to claim 1, wherein the pull handle assembly comprises a handle, a joint plate to which the handle is pivotally connected, and linking members for linking the handle and the positioning member to each other; the handle comprises pivot holes and connection hole formed therein; the joint plate has a top mounted to the primary desktop and the joint plate has a bottom from which two pivot lugs project outward, the pivot lugs being provided for pivotal connection with the pivot holes of the handle; the linking members have an end connected to the connection holes of the handle and the linking members have an opposite end connected to the mounting sections of the positioning member.

5. The platform on desktop with elevation function according to claim 1, wherein the pusher assemblies each comprise a bolt and a push spring fit over and encompassing the bolt.

6. The platform on desktop with elevation function according to claim 1, wherein the elevation assembly further comprises an ancillary bar connected to the first bar and a tension spring connected between the ancillary bar and the lower connection plate.

7. The platform on desktop with elevation function according to claim 6, wherein the tension spring is connected between the ancillary bar and the lower connection plate in an inclined form and is located under the return spring.

* * * * *